US005888175A

United States Patent [19]

Chang

[11] Patent Number: 5,888,175

[45] Date of Patent: Mar. 30, 1999

[54] STRUCTURE OF STEP EXERCISING MACHINE

[76] Inventor: Major Chang, 1F, No. 764, Chung Shan South Rd., Yang Mei Town, Tao Yuan Hsien, Taiwan

[21] Appl. No.: 993,093

[22] Filed: Dec. 18, 1997

[51] Int. Cl.[6] ..... A63B 22/04; A63B 22/14

[52] U.S. Cl. ..... 482/53; 482/147

[58] Field of Search ..... 482/148, 146, 482/147, 52, 53, 51, 79, 80, 111, 112

[56] References Cited

U.S. PATENT DOCUMENTS

| | | | |
|---|---|---|---|
| 5,348,520 | 9/1994 | Chang | 482/52 |
| 5,453,065 | 9/1995 | Lien | 482/147 X |
| 5,545,111 | 8/1996 | Wang | 482/147 X |
| 5,628,709 | 5/1997 | Chen | 482/146 X |
| 5,645,512 | 7/1997 | Yu | 482/147 X |
| 5,676,623 | 10/1997 | Yu | 482/53 |
| 5,800,313 | 9/1998 | Yu | 482/146 X |

*Primary Examiner*—Richard J. Apley
*Assistant Examiner*—William LaMarca
*Attorney, Agent, or Firm*—Rosenberg, Klein & Bilker

[57] ABSTRACT

A step exercising machine including a pivotable mounting rack turned around an axial tube on an arched bar of a base frame and a transverse retaining rod disposed on the arched bar, two transverse mounting shafts bilaterally disposed to the pivotable rack, two pedals respectively turned about two opposite ends of a first mounting shaft and supported on a respective hydraulic cylinder and respectively pushed against the retaining rod by a respective downward driving rod, wherein the pivotable rack is turned around the axial tube of the arched bar forwards and backwards alternatively when the pedals are alternatively moved up and down, causing the pedals to oscillate leftwards and rightwards alternatively.

3 Claims, 6 Drawing Sheets

STRUCTURE OF STEP EXERCISING MACHINE

BACKGROUND OF THE INVENTION

The present invention relates to step exercising machines, and relates more particularly to such a step exercising machine which forces the pedals to oscillate leftwards and rightwards alternatively, when the pedals are peddled up and down.

FIGS. 4 and 5 show a step exercising machine according to the prior art. This structure of step exercising machine comprises a base 1' having an upright post 11' and a horizontally disposed arched rack 12', a hollow revolving shaft 4' sleeved onto the upright post 11', bearing 44' mounted on the revolving shaft 4' at the top, a top transverse rod 41' and a bottom transverse rod 42' fixedly fastened to the periphery of the revolving shaft 4' at the back side at different elevations, a horizontal gear holder 43' perpendicularly connected to the revolving shaft 4' at the front side to hold a sprocket wheel 5' and a sector gear 51', permitting the sector gear 51' to be maintained in engagement with the rack 12', two pedals 2' adapted for pedaling, and two hydraulic cylinders 3' adapted for providing a damping force to the pedals 2'. Each pedal has a barrel 21 ' at the rear end coupled to one end of the top transverse rod 41', a downward coupling plate 22' disposed below the barrel 21' and coupled to one end of the bottom transverse rod 42', and a bottom ring 23' near the front end. Each hydraulic cylinder 3' has a coupling ring 32' at the rear end of the casing thereof coupled to one end of the bottom transverse rod 42', and a piston rod 31 ' with an eyed end 33' pivoted to the bottom ring 23' of one pedal 2'. Furthermore, a chain 6' is mounted on the sprocket wheel 5', having two opposite ends respectively connected to the downward coupling plates 22' of the pedals 2'; and upright frame 7' may be fastened to the upright post 4' to hold a handlebar 71'. When the pedals are peddled, the revolving shaft is forced to turn forwards and backwards alternatively, thereby causing the pedals to oscillate leftwards and rightwards alternatively. However, this structure of step exercising machine has drawbacks. One drawback of this structure of step exercising machine is that high noises will be produced when the chain and the sector gear are respectively moved relative to the sprocket wheel and the rack. Another drawback of this structure of step exercising machine is that the chain tends to disengage from the sprocket wheel during the operation of the step exercising machine. Furthermore, this structure of step exercising machine is complicated, therefore its manufacturing cost is high.

SUMMARY OF THE INVENTION

The present invention has been accomplished to provide a step exercising machine which eliminates the aforesaid drawbacks. It is one object of the present invention to provide a step exercising machine which produces little noise when operated. It is another object of the present invention to provide a step exercising machine which is durable in use. It is still another object of the present invention to provide a step exercising machine which is simple in structure, and inexpensive to manufacture. According to the preferred embodiment of the present invention, the step exercising machine comprises a pivotable mounting rack turned around an axial tube on a longitudinal arched bar of a base frame, and a transverse retaining rod on the arched bar, two transverse mounting shafts bilaterally disposed to the pivotable mounting rack, two pedals respectively turned about two opposite ends of a first transverse shaft and supported on a respective hydraulic cylinder and respectively pushed against the retaining rod by a respective downward driving rod, wherein the pivotable mounting rack is turned around the axial tube of the arched bar forwards and backwards alternatively when the pedals are alternatively moved up and down, causing the pedals to oscillate leftwards and rightwards alternatively.

DETAILED DESCRIPTION OF THE PRESENT INVENTION

Figure 1:
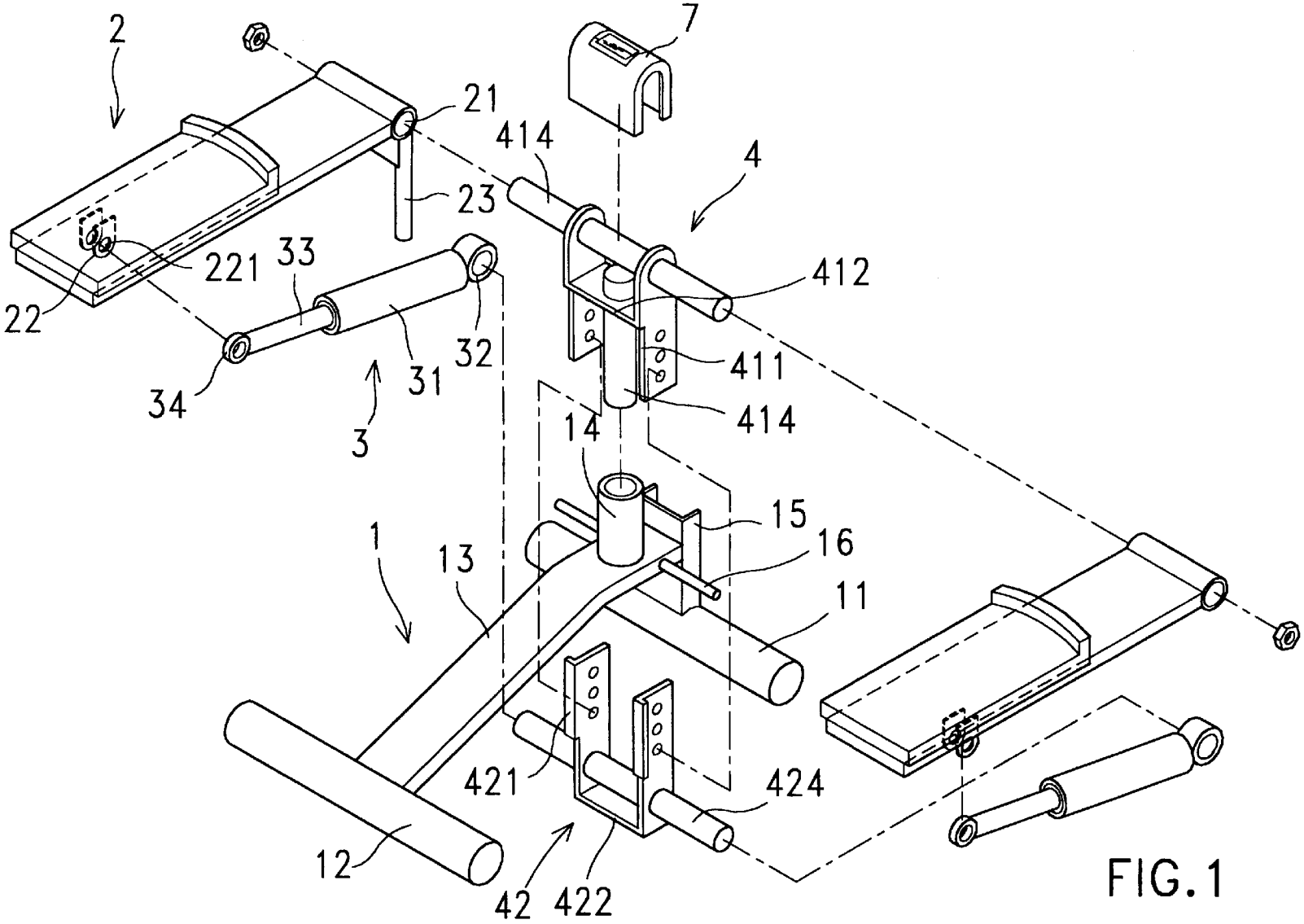
FIG. 1 is an exploded view of a step exercising machine according to the present invention (upright frame and handlebar excluded)
Figure 2:
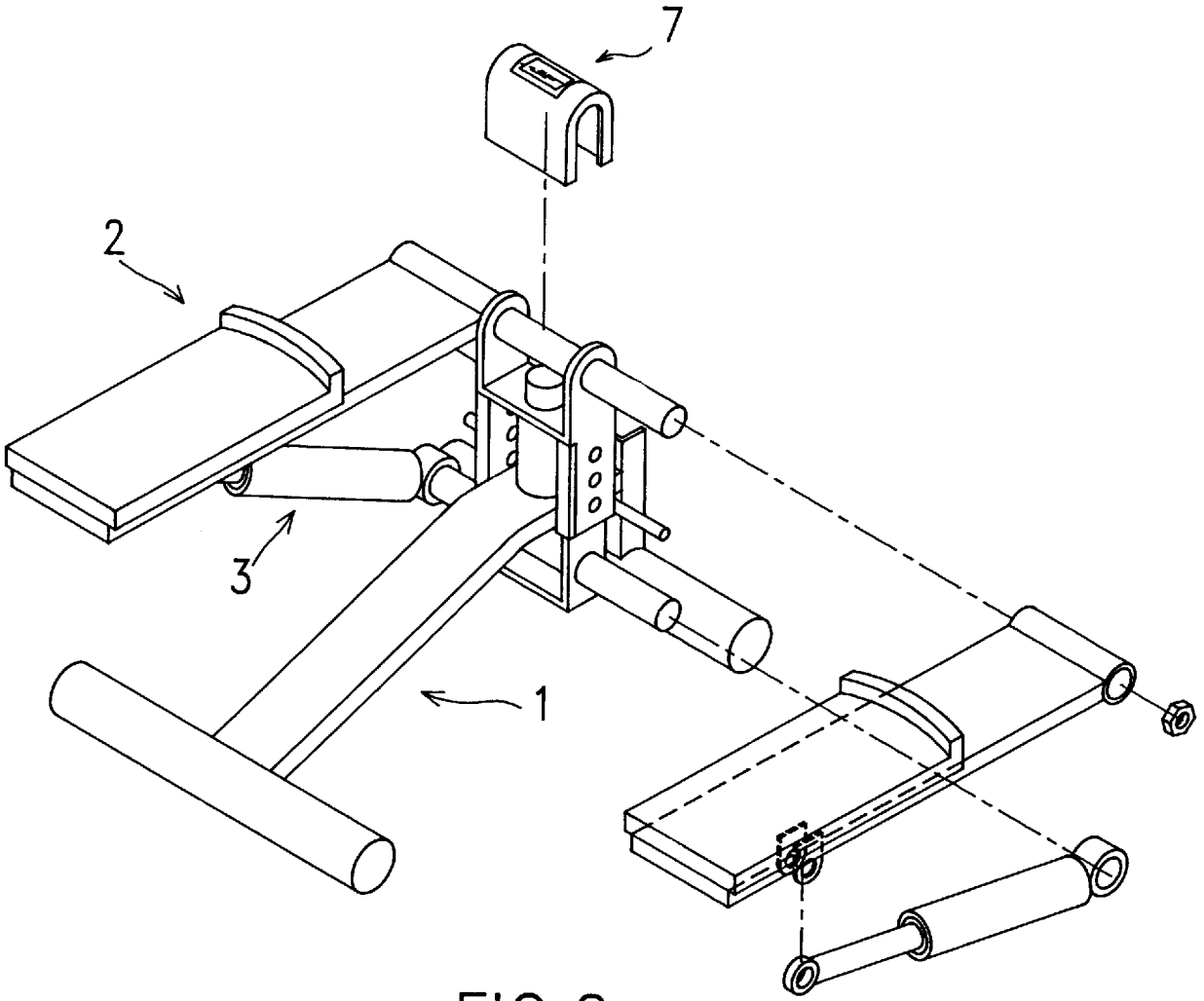
FIG. 2 is an elevational of the step exercising machine shown in FIG. 1 during assembling.

Referring to FIG. 1 and FIG. 2, a step exercising machine in accordance with the present invention comprises:

a base frame 1 including a front transverse tubular member 11 having a upright "U" channel support 15 at a middle thereof, a rear transverse tubular member 12 and a rectangular arched bar 13 having a rear end horizontally connected to a middle of the rear tubular member 12 and an arched front end raised to connect with the upright "U" channel support 15 thereon for providing a mounting space under the front portion of the arched bar 13, an upright axial tube 14 disposed through the front portion of the arched bar 13 near the "U" channel support 15, and two opposite retaining rods 16 laterally disposed on two opposite sides of the arched bar 13 at a front position forwardly adjacent to the upright axial tube 14. a pivotable mounting rack 4 made of metal plate and composed of an upper rack 41 and a lower rack 42, which the upper rack 41 is formed of a "H" shape consisted of two vertical side plates 411 with a certain distance much larger than the width of the arched bar 13, a horizontal plate 412, a center tube 414 disposed downwardly from a center of the horizontal plate 412 for pivotablly inserting into the axial tube 14 of the base frame 1, and a first transverse shaft 413 fixedly disposed over the horizontal plate 412 having both ends extend outwardly through a respective hole on each vertical plate 411 thereof, while the lower rack 42 is formed of a "U" shape having two vertical side plates 421 and a horizontal bottom plate 422, a second transverse shaft 424 laid on the bottom plate 422 having both end extended outwardly through a respective hole on each vertical plate 421 thereof; during assembling, the lower rack 42 will be suspended in the mounting space under the front portion of the arched bar 13 of the base frame 1 and fastened to the upper rack 41 crossed over the arched bar 13 by a plurality of screws (not shown) coupled the two vertical plates 421 of the "U" shaped rower rack 42 onto the lower portion of the vertical plates 411 of the "H" shaped upper rack 41 through a plurality of corresponding screw holes thereon.

A pair of pedals 2 each having a lateral hollow barrel 21 at a front end thereof for mounting onto either end of the first transverse shaft 414 of the pivotable mounting rack 4, two connecting lugs 22 with a respective through hole 221 provided downwardly from the bottom surface near the rear end thereof, and a downward driving rod 23 disposed on a front end at one side near the pivot center of the pivotable rack 4 and tended to contact with the corresponding retaining rod 16 of the base frame 1 as the pedal 2 has been mounted onto the rack 4 and the rack 4 has been mounted on the axial tube 14 of the base frame 1.

Two hydraulic cylinders 3 each having a cylinder body 31 with a coupling ring 32 at a closed end for mounting onto a respective end of the second transverse shaft 424 of the pivotable rack 4, a piston rod 33 stretched out from the cylinder barrel 31 having an eyed end 34 coupled with the connecting lugs 22 of a corresponding pedal 2 by a pivot pin (not shown).

Figure 2A:
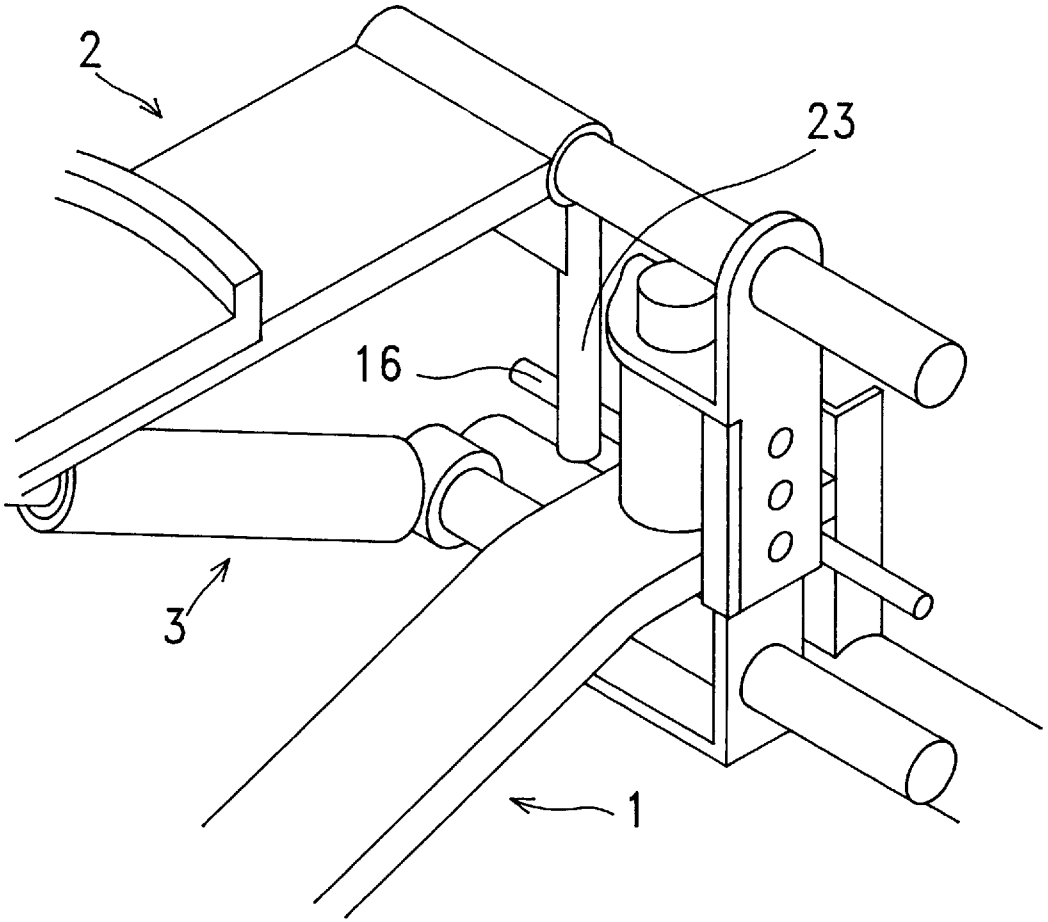
FIG. 2A is an enlarged partial view of FIG. 2.

Referring to FIG. 2A, which shows that the leading edge of the downward driving rod 23 of the left pedal 2 is going to contact with the left retain rod 16 of the base frame 1 and a trust force will acting to the retain rod 16 when the exerciser steps down the left foot and looses the right foot, since the retain rod 16 is fixedly mounted in position and cannot be moved, there will be a reacting force pushed the left pedal backwardly to cause the pivotable mounting rack 4 turned to right, then a swing motion will be occurred while alternatively steps down and looses the pedals one after another.

Figure 3:
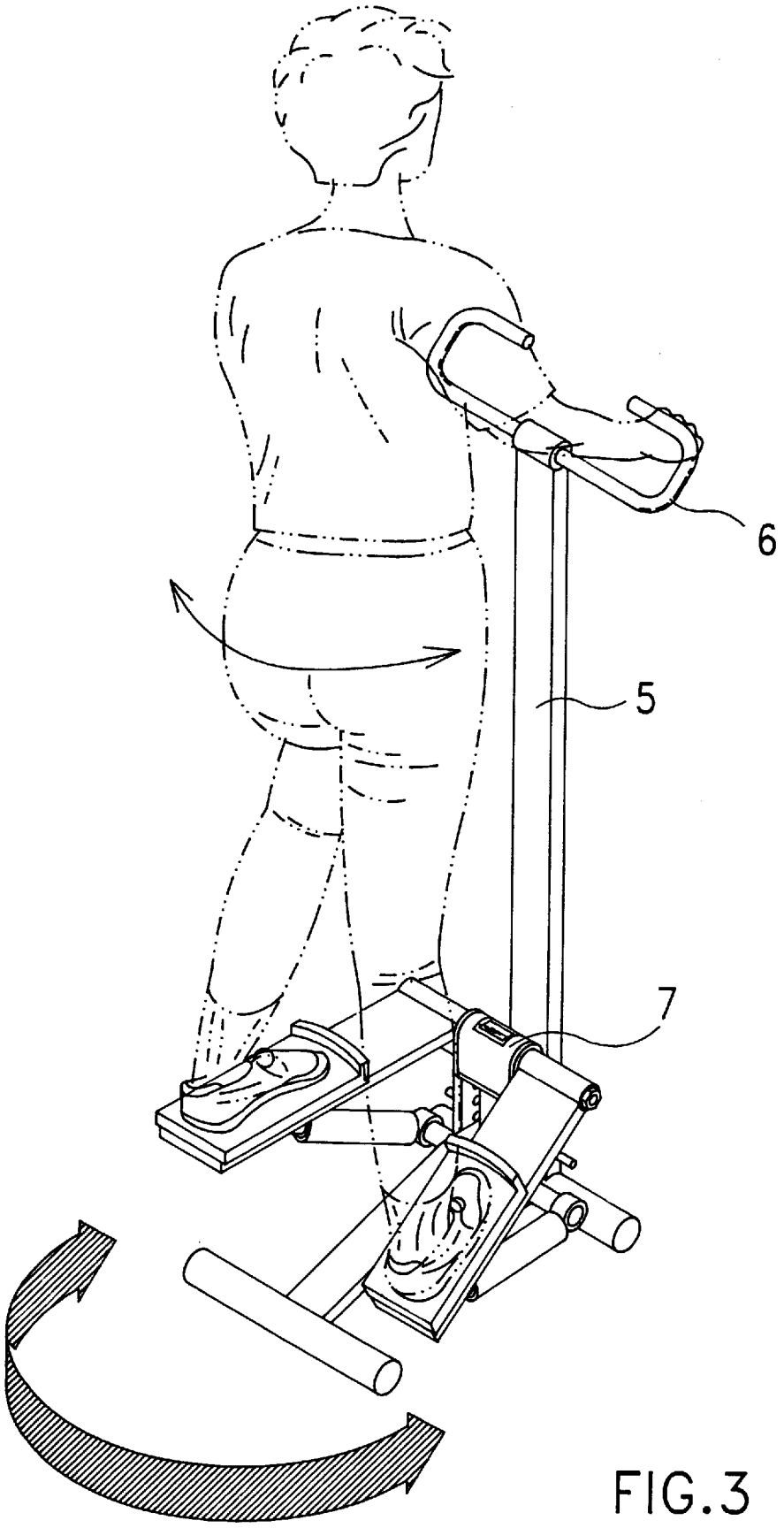
FIG. 3 is an elevational view of the step exercising machine operated by a exerciser, and showing an upright stand mounted on the upright support and a handlebar fastened to the top of the upright frame.
Figure 4:
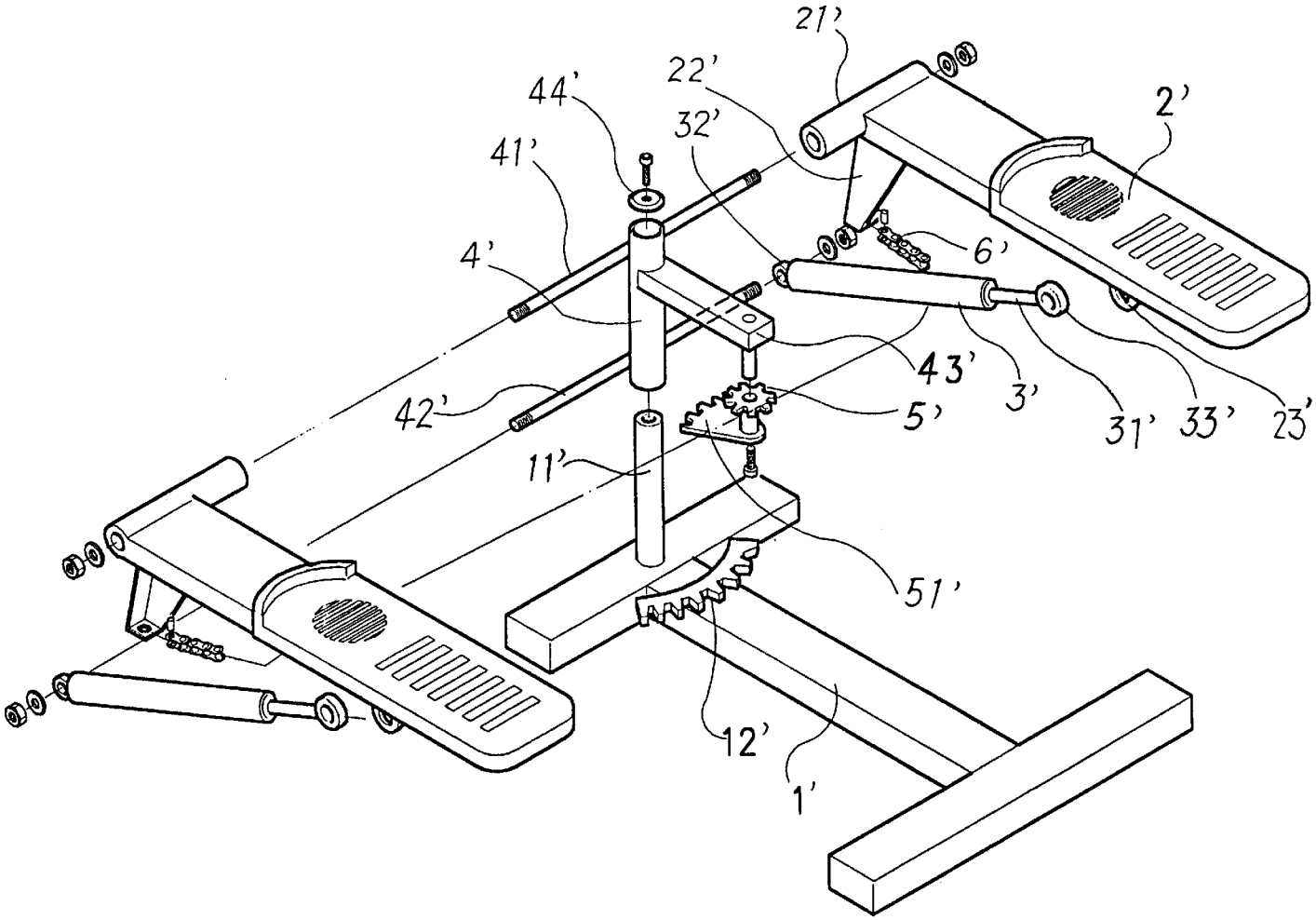
FIG. 4 (PRIOR ART)
FIG. 4 is an exploded view of a step exercising machine according to the prior art; and, FIG. 5 is a perspective elevational view of the step exercising machine shown in FIG. 4.
Figure 5:
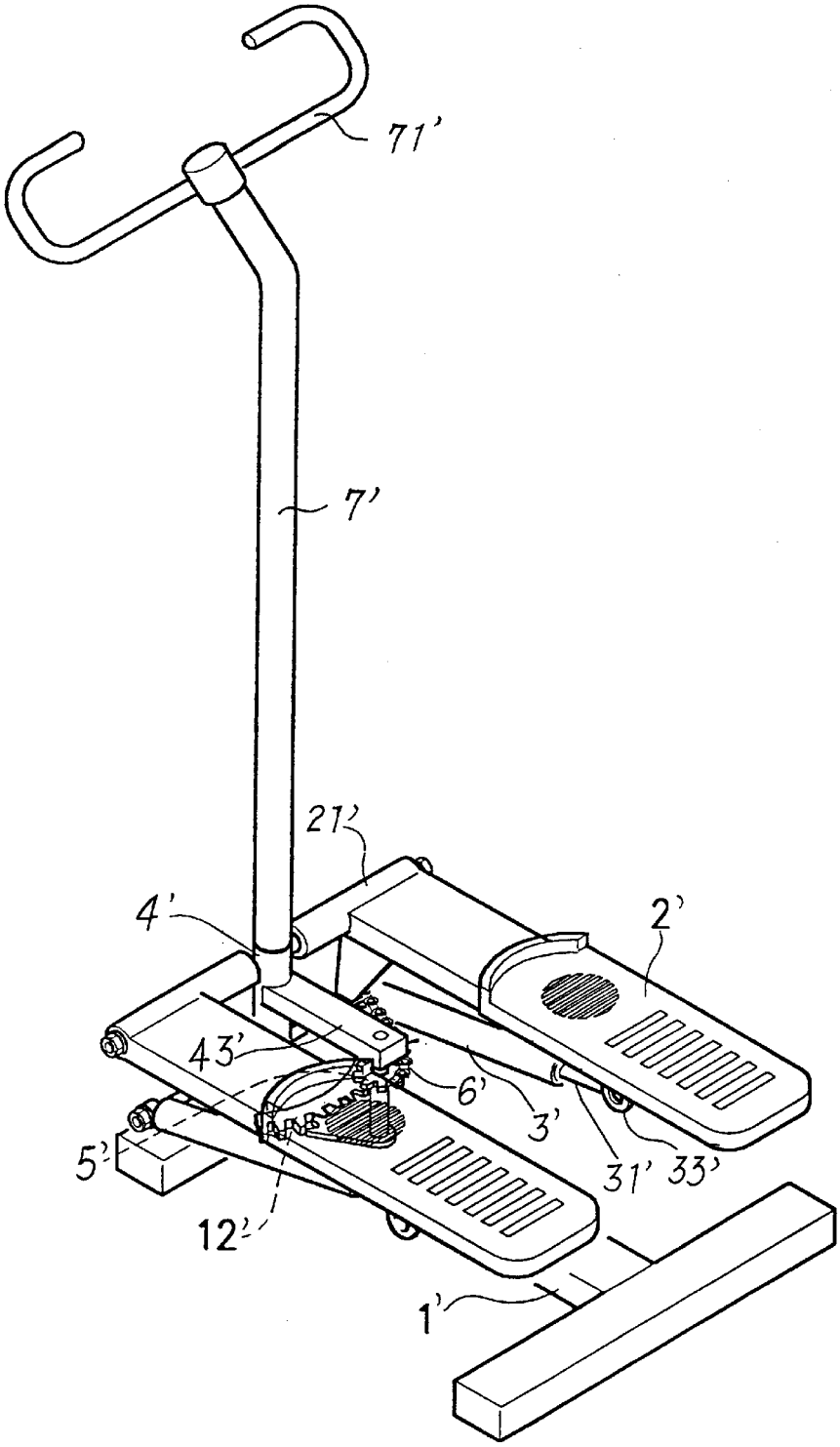
FIG.5 (PRIOR ART)

Referring to FIG. 3, a bar stand 5 and a handlebar 6 are fixedly mounted on the upright "U" channel 15 of the base frame 1. So as to keep the upper body of the exerciser in a normal manner for increasing the relative movement as the lower body is swinging during exercising.

I claim:

1. A step exercising machine comprising: a base frame, a pivotable mounting rack, a pair of pedals, two hydraulic cylinders and a handle bar;

said base frame is composed of a transverse front member having an upright "U" shaped channel support at a middle portion thereof, a longitudinal arched bar having a rear end connected to a transverse rear member and an arched front flat portion connected to said upright "U" shaped channel support, an upright axial tube raised from a front portion of said arched bar and two opposite retaining rods laterally disposed on opposite sides of said arched bar forwardly adjacent to said upright axial tube near said upright "U" shaped channel support there at;

said pivotable mounting rack made of a metal plate and composed of a "H" shaped upper rack and a "U" shaped lower rack, where said upper rack comprises a horizontal plate, two opposite vertical plates and a first transverse shaft disposed on a top over said horizontal plate with both ends extended out passing through respective vertical plates thereof, a center tube disposed downwardly from said base frame pivotably fitted therein, while said "U" shaped lower rack is placed in said mounting space under said arched bar and suspended from said "H" shaped upper rack which is crossed over said arched bar, and having a second transverse shaft disposed over a bottom plate of said "U" shaped lower rack thereof;

said pair of pedals each having a lateral hollow barrel at a front end for mounting onto said first transverse shaft of said pivotable mounting rack, two connecting lugs with a respective through hole provided downwardly from a bottom surface of said pedals near a rear end thereof and a driving rod disposed downwardly under a front end of said pedals that is positioned at one side near said axial tube when in assembled condition;

said two hydraulic cylinders each having a cylinder body with a coupling ring at one end for mounting onto said second transverse shaft of said pivotably mounting rack, a piston rod stretched out from said cylinder body's second end having an eyed end mounted to said connecting lugs of said pedal by a pivot pin; and said handlebar having a bar stand mounted on said upright "U" shaped channel of said base frame.

2. A step exercising machine according to claim 1, wherein said arched bar is positionally located within a mounting space formed by said "U" shaped lower rack coupled to said "H" shaped upper rack of said pivotable mounting rack.

3. A step exercising machine according to claim 1 wherein said handlebar is fixedly mounted so as to assist a user in maintaining a substantially still upper body relative to the user's swinging lower body during exercise.

* * * * *

UNITED STATES PATENT AND TRADEMARK OFFICE

CERTIFICATE OF CORRECTION

PATENT NO. : 5,888,175

DATED : MARCH 30, 1999

INVENTOR(S) : MAJOR CHANG

It is certified that error appears in the above-identified patent and that said Letters Patent is hereby corrected as shown below:

TITLE PAGE, AFTER BOX [22] INSERT

--RELATED U.S. APPLICATION DATA
[63] Continuation-in-part of Ser. No. 08/736,006, Oct. 3, 1996, abandoned.--

Signed and Sealed this

Fourth Day of July, 2000

*Attest:*

Q. TODD DICKINSON

*Attesting Officer*

*Director of Patents and Trademarks*